United States Patent [19]

Higashigawa

[11] 4,146,593

[45] Mar. 27, 1979

[54] DIAPHRAGM MEANS FOR DRIVING A SECONDARY THROTTLE VALVE IN A TWO-BARREL CARBURETOR

[75] Inventor: Keizo Higashigawa, Toyota, Japan

[73] Assignee: Toyota Jidosha Kogyo Kabushiki Kaisha, Toyota, Japan

[21] Appl. No.: 785,953

[22] Filed: Apr. 8, 1977

[30] Foreign Application Priority Data

Feb. 4, 1977 [JP] Japan ..... 52/11345

[51] Int. Cl.[2] ..... F02M 11/04

[52] U.S. Cl. ..... 261/23 A; 123/127; 251/55; 251/61.5; 261/41 C; 261/DIG. 18

[58] Field of Search ..... 251/48, 50, 51, 52, 251/61.5, 55; 261/DIG. 18, 23 A, 41 A, 41 R, 41 C; 123/127

[56] References Cited

U.S. PATENT DOCUMENTS

| | | | |
|---|---|---|---|
| 2,075,330 | 3/1937 | Angell, Jr. et al. | 261/41 R |
| 2,692,651 | 10/1954 | Ball | 261/DIG. 18 |
| 2,732,038 | 1/1956 | Olson et al. | 251/48 |
| 2,759,698 | 8/1956 | Jorgenson, Jr. | 251/48 |
| 2,782,025 | 2/1957 | Olson | 251/48 |
| 2,798,703 | 7/1957 | Carlson et al. | 123/127 |
| 2,823,020 | 2/1958 | Smith | 261/23 A |
| 3,237,527 | 3/1966 | Martin | 261/DIG. 18 |
| 3,266,791 | 8/1966 | Emerson | 261/DIG. 18 |
| 3,287,007 | 11/1966 | Schoeppach | 261/DIG. 18 |
| 3,881,685 | 5/1975 | Hase et al. | 261/DIG. 18 |
| 4,022,179 | 5/1977 | Kalert et al. | 261/DIG. 18 |

FOREIGN PATENT DOCUMENTS

| | | | |
|---|---|---|---|
| 1426164 | 9/1969 | Fed. Rep. of Germany | 123/127 |

*Primary Examiner*—Martin P. Schwadron
*Assistant Examiner*—G. L. Walton
*Attorney, Agent, or Firm*—Stevens, Davis, Miller & Mosher

[57] ABSTRACT

A diaphragm means for driving a secondary throttle valve in a two-barrel carburetor of the type wherein the secondary throttle valve is opened by a diaphragm means actuated by the venturi vacuum when the primary throttle valve is opened, including an expanding and contracting diaphragm rod, which is normally contracted but which is expanded against a spring face when the secondary throttle is being forcibly held closed during high-speed running, and whose contraction is damped.

5 Claims, 2 Drawing Figures

DIAPHRAGM MEANS FOR DRIVING A SECONDARY THROTTLE VALVE IN A TWO-BARREL CARBURETOR

BACKGROUND OF THE INVENTION

1. Field of the Invention

The present invention relates to a two-barrel carburetor for automobile engines or the like and, more particularly, to an improvement of a diaphragm means for driving a secondary throttle valve.

2. Description of the Prior Art

Recently, automobile engines have incorporated two-barrel carburetors having a primary bore and a secondary bore. The two-barrel carburetor has a primary throttle valve, a primary venturi, a primary fuel nozzle, etc., in the primary bore, while it has a secondary throttle valve, a secondary venturi, a secondary fuel nozzle, etc., in the secondary bore. Said primary throttle valve is directly driven by an accelerator pedal-linked system, while said secondary throttle valve is usually driven by a diaphragm means which responds to the vacuum generated by the intake air flow. The diaphragm means for driving the secondary throttle valve is generally adapted to drive the secondary throttle valve toward its open position, in response to the vacuum supplied from the primary and secondary venturi portions to a diaphragm chamber of the diapragm means, against the biasing action of a diaphragm spring disposed in the diaphragm chamber which drives the secondary throttle valve toward its closed position. When the primary throttle valve is opened more, a greater vacuum is generated by the stream of intake air flowing through the primary venturi portion, said vacuum being supplied to the diaphragm chamber of said diaphragm means for opening the secondary throttle valve. However, since the secondary throttle valve is to be maintained in a closed condition until the primary throttle valve reaches a predetermined open position such as, for example, about 50° of rotation from its full closed position, a cam mechanism is provided between the primary and secondary throttle valves for restraining the secondary throttle valve in its full closed position until the primary throttle valve is opened beyond the predetermined angle. Therefore, it is a necessary condition for the secondary throttle valve to be opened by the diaphragm means that the primary throttle valve should be opened beyond the predetermined angle, i.e., the so-called critical angle.

It has been found that a two-barrel carburetor of the above mentioned type having a secondary throttle valve driven by a diaphragm means, provides improved air intake efficiency and operational co-operation between the primary and secondary throttle valves because it does not require any auxiliary valve in the secondary bore such as required in two-barrel carburetors having a mechanical, rigid connection between the primary and secondary throttle valves. However, when the vehicle is accelerated starting from high speed road load running, especially when, for instance, the transmission is in the high speed shift stage, the venturi vacuum supplied to the diaphram chamber of said diaphragm means is already large enough to open the secondary throttle valve before the primary throttle valve reaches said critical angle and therefore the problem occurs that when the primary throttle valve is opened beyond said critical angle so that the restriction imposed by the cam mechanism is removed, the secondary throttle valve is abruptly opened to a substantial extent directly on the heals of the opening of the main fuel supply relative to the supply of intake air. Such a delay in the fuel supply causes an abrupt change of the engine output torque which generates an unpleasant shock.

SUMMARY OF THE INVENTION

It is therefore the object of the present invention to solve the above-mentioned problem in a conventional two-barrel carburetor having a diaphragm-driven secondary throttle valve and to provide an improved diaphragm means for driving the secondary throttle valve, wherein abrupt opening of the secondary throttle valve is avoided particularly in the circumstances of acceleration from high speed running, thereby giving improved smoothness in acceleration.

In accordance with the present invention, the above-mentioned object is accomplished by a diaphragm means for driving a secondary throttle valve in response to the venturi vacuum toward its open position, comprising a casing, a diaphragm which co-operates with said casing to define a diaphragm chamber on one side thereof, said diaphragm chamber being supplied with the venturi vacuum, a diaphragm rod having one end connected to said diaphragm and the other end drivingly connected with said secondary throttle valve, and a diaphragm spring which resiliently drives said diaphragm rod in the direction to close said secondary throttle valve, said diaphragm rod being expansible and contractable in its directions under the reaction of a spring force and a damping force which are effected in opposite directions.

BRIEF DESCRIPTION OF THE DRAWING

The above and other objects and features of the invention will become more apparent from the following description taken in connection with the accompanying drawings in which.

DESCRIPTION OF THE PREFERRED EMBODIMENT

Figure 1:
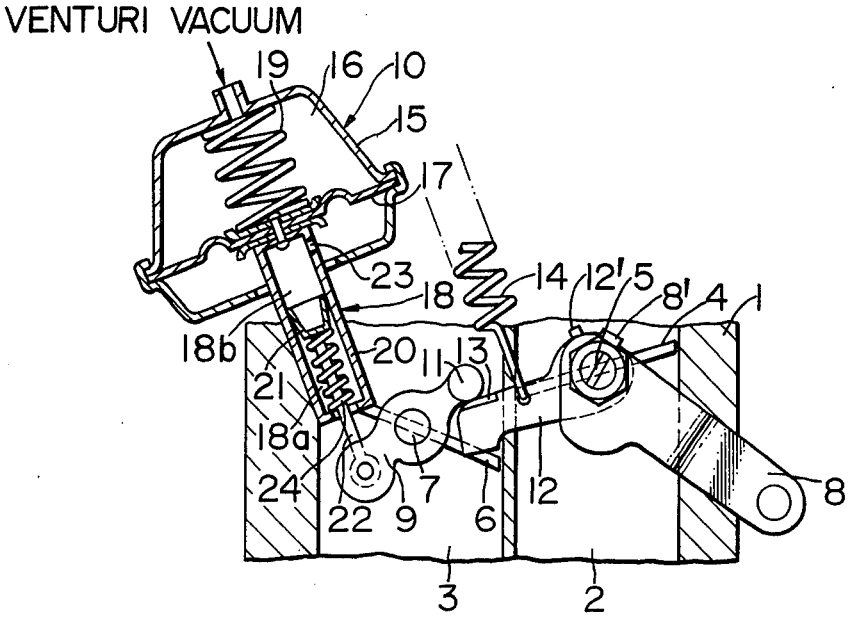
FIG. 1 is a schematic illustration of the essential parts of a two-barrel carburetor incorporating a diaphragm means for driving the secondary throttle valve in accordance with the present invention.

Referring now to FIG. 1 which illustrates a connection between the primary throttle valve and the secondary throttle valve of a two-barrel carburetor having the diaphragm means of the present invention, 1 designates the carburetor body which has a primary bore 2 and a secondary bore 3 arranged in parallel with each other. In the primary bore 2 is a primary throttle valve 4 which is fixedly supported by a primary throttle valve shaft 5 which is in turn rotatably supported by the body 1. The throttle valve 4 rotates together with the valve shaft 5 so as to control the flow area of the primary bore 2, and in the drawing this flow area is increased when the throttle valve 4 and the throttle valve shaft 5 turn in the anti-clockwise direction. The secondary bore 3 incorporates a secondary throttle valve 6 fixedly supported by a secondary throttle valve shaft 7 supported rotatably by the body 1, said secondary throttle valve being also rotatable together with the valve shaft 7 so as to control the flow area of the secondary bore 3. One end of the primary throttle valve shaft 5 projecting outward from the body 1 carries a primary throttle lever 8 fixedly mounted thereto, said lever being connected to an accelerator pedal-linked system (not shown in the drawing) and adapted to drive said primary throttle valve 4. Similarly, one end of the secondary throttle valve shaft 7 projecting outward from the body 1 carries a secondary throttle lever 9 fixedly mounted thereto, said lever having one end connected to the diaphragm means 10 of the present invention and the other end having a pin 11 which engages a contact surface formed at one end of a cam lever 12. The other end of the cam lever 12 is rotatably supported on the primary throttle valve shaft 5. The cam lever 12 is impelled by a tension coil spring 14 in the clockwise direction as seen in the drawing around the valve shaft 5 and is adapted to maintain the secondary throttle valve 6 at its full closed position (as shown in the drawing,) until the primary throttle valve 4 opens as far as a predetermined angle, i.e., the so-called critical angle. In more detail, the cam lever 12 has a projection 12' which engages a projection 8' of the primary throttle lever 8 when the primary throttle lever 8 is rotated, for example, as much as 50° in the anti-clockwise direction from the idling position as shown in the drawing. When the primary throttle lever 8 is further rotated beyond, for example, 50°, the projection 8' pushes the projection 12', thereby rotating the cam lever 12 in an anti-clockwise direction against the force of the spring 14. Thus the secondary throttle lever 9 is rotated in the direction to open the secondary throttle valve 6.

The diaphragm means 10 comprises a casing assembly 15, a diaphragm 17 stretched in the casing assembly 15 so as to define in co-operation with it a diaphragm chamber 16 to which is supplied the venturi vacuum. This chamber is on the upper side of the diaphragm 17 as seen in the drawing. A diaphragm rod 18 has its one end carried by the diaphragm 17 to extend downward therefrom, and its other end is pivotably connected to one end of the secondary throttle lever 9. A diaphragm spring 19 is disposed in the diaphragm chamber 16 so as to drive the diaphragm and the diapragm rod downward in the drawing, i.e., so as to drive the secondary throttle valve 6 toward its closed position.

Now, in accordance with the present invention, the diaphragm rod 18 is particularly devised. In the shown embodiment the diaphragm rod 18 comprises a cylinder tube 20 having an upper end integrally connected to the lower surface of said diaphragm 17, and a piston rod 22 having an upper end provided with a piston 21 slidably received in said cylinder tube 20 and a lower end projecting outward from the lower end of said cylinder tube 20 and pivotably connected with one end of the secondary throttle lever 9. Thus the diaphragm rod 18 is, as a whole, expansible and contractable in its axial direction. One of the two chambers defined in the cylinder tube and separated by said piston 21, namely the lower chamber **18*a* in the drawing, is opened to the atmosphere without any substantial restriction, while the other chamber, namely the upper chamber 18*b* in the drawing, is opened to the atmosphere through a throttling orifice 23 formed in the cylinder tube 20. In the shown embodiment, the piston 21 is a cup-shaped element made of leather or the like, which acts as a valve so that the piston 21 holds air in the chamber 18*b* when it moves upward in the drawing in the direction to reduce the volume of the chamber 18*b*, while on the other hand the piston 21 releases air itself from the chamber 18*a* to the chamber 18*b* when it moves in the opposite direction, so as to increase the volume of the cahmber 18*b*, downward in the drawing. In the chamber 18*a* is a compression coil spring 24 which acts between the piston 21 and the lower end of the cylinder 20** to bias them apart.

In operation, when the primary throttle valve 4 is in the idling position with no substantial venturi vacuum being generated, the secondary throttle valve 6, the secondary throttle lever 9 and the diaphragm means 10 are positioned in positions such as shown in the drawing. Starting from this condition, when the primary throttle lever 8 is rotated in an anti-clockwise direction, the primary throttle valve 4 integrally connected therewith is also rotated in the same direction and opens the primary bore 2. Consequently, the intake air flow through the primary bore 2 increases so that a substantial venturi vacuum is generated and is supplied to the diaphragm chamber 16 of the diaphragm means 10. This venturi vacuum biases the diaphragm 17 upward in the drawing against the force of the diaphragm spring 19. However if the opening angle of the primary throttle valve 4 is less than the critical angle the upward displacement of the diaphragm 17 is absorbed by an upward displacement of the cylinder tube 20 relative to the piston rod 22, which is effected against the force of the compression coil spring 24. The secondary throttle valve 6 is not opened at all, because the contact surface 13 of the cam lever 12 engages the pin 11 of the secondary throttle lever 9 so as to maintain the secondary throttle valve 6 in its full closed position as shown in the drawing. During the upward displacement of the cylinder tube 20 relative to the piston rod 22, air is introduced into the chamber **18*b* from the outside atmosphere through the throttling orifice 23 as well as from the chamber 18*a* past the piston 21, and there by this upward displacement is performed without being subject to any substantial damping force, but is subject to only the force of the compression coil spring 24. When the engine speed further increases so that the intake air flow through the primary bore 2 also further increases, venturi vacuum of a level capable of opening the secondary throttle valve 6 is supplied to the diaphragm chamber 16 of the diaphragm means 10 before the opening angle of the primary throttle valve 4 reaches the critical angle. Thereby the diapragm 17 and the cylinder tube 20 are displaced upwardly in the drawing against the force of the diaphragm spring 19 and set at a position corresponding to the full open position of the secondary throttle valve 6. In this condition, when the primary throttle valve 4 is opened beyond the critical angle so that the cam lever 12 releases the secondary throttle lever 9, the secondary throttle valve 6 begins to rotate in the clockwise direction in the drawing, toward its open position. This rotation is effected by the upward shifting of the piston rod 22 relative to the cylinder tube 20 due to the force of the compression coil spring 24. In this shifting, the air contained in the chamber 18*b* is exhausted through the throttling orifice 23 in a restricted manner and the damping force caused by this fluid resistance is applied to the piston rod. Consequently, in accleration from high speed running condition, the secondary throttle valve 6** is gradually opened against the damping force applied by said cylinder-piston mechanism.

If, on the other hand, the venturi vacuum supplied to the diaphragm chamber 16 is not yet at the level capable of opening the secondary throttle valve 6 when the primary throttle valve 4 is opened beyond the critical angle, such as, for instance, in acceleration from low speed running, the secondary throttle valve 6 is opened in the usual manner in accordance with the upward shifting of the diaphragm 17, due to the increase of the venturi vacuum supplied to the chamber 16, wherein the combination of the cylinder tube 20 and the piston rod 22 operates as a substantially rigid rod structure.

When the primary throttle valve 4 is closed across the critical angle starting from the condition wherein the secondary throttle valve 6 is open, the pin 11 of the secondary throttle lever 9 is driven upward by the cam lever 12, whereby the secondary throttle valve 6 is compulsorily closed. Therefore, even when substantial venturi vacuum remains in the diaphram chamber 16, the secondary throttle valve 6 is instantaneously and positively closed.

Figure 2:
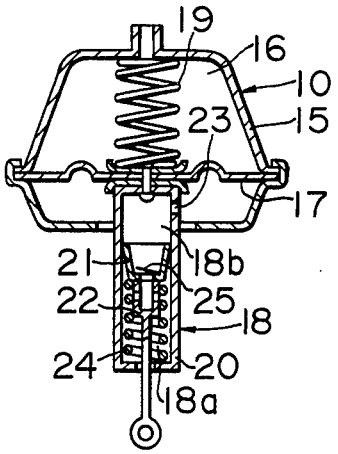
FIG. 2 is a sectional view showing another diaphragm means for driving a secondary throttle valve, which is another embodiment in accordance with the present invention.

FIG. 2 shows another embodiment of the diaphragm means of the present invention wherein the same reference numerals are attached to those parts corresponding to those shown in FIG. 1. In this embodiment, the piston 21 is provided with a one-way valve element 25 of the flapper type. The one-way valve element 25 is adapted to intercept the communication between the chambers 18*a* and 18*b* when the piston 21 moves upward in the drawing, while it allows the chambers 18*a* and 18*b* to communicate when the piston 21 moves downward in the drawing. Therefore, also in this embodiment, the displacement of the piston rod 22 in the upward direction, i.e., in the direction to open the secondary throttle valve, is performed against the damping force applied by the air contained in the chamber 18*b* being exhausted through the throttling orifice 23.

Although the invention has been shown and described with reference to some preferred embodiments thereof, it will be understood by those skilled in the art that various modifications may be made therein without departing from the spirit and scope of the invention.

I claim:

1. In a two-barrel carburetor having primary and secondary bores and primary and secondary throttle valves mounted therein, said second throttle valve being openable when said primary throttle valve is opened beyond a critical opening, a diaphragm means which acts in response to venturi vacuum and which controls the position of the secondary throttle valve over its entire range of movement, means for controlling the opening of the second throttle valve comprising a casing, a diaphragm which co-operates with said casing to define a diaphragm chamber on one side thereof, said diaphragm chamber being supplied with venturi vacuum, a diaphragm rod having one end connected to said diaphragm and the other end drivingly connected to said secondary throttle valve, said diaphragm rod comprises a cylinder tube having one end integrally connected with said diaphragm, a piston slidably received in said cylinder tube, and a piston one end of which is connected to said piston and the other end of which projectss outward from the other end of said cylinder tube which is connected to the secondary throttle valve and a diaphragm spring which resiliently drives said diaphragm rod in the direction to close said secondary throttle valve, wherein said diaphragm rod is variable in length and has a biasing spring which biases the length of said rod so as to alter it in the direction to open said secondary throttle valve and a damping means which damps the biasing action of said biasing spring.

2. The diaphragm means of claim 1, wherein two chambers are defined in said cylinder tube and separated by said piston, one of said chambers being opened to the atmosphere without any substantial restriction while the other chamber is opened to the outside atmosphere through a throttling orifice formed in said cylinder tube.

3. The diaphragm means of claim 2, wherein said piston is a cup-shaped element made of a flexible material which prevents air passing around itself between said chambers when it is driven in one direction, while it releases air around itself between said chambers when it is driven in the other direction.

4. The diaphragm means of claim 2, wherein said piston is provided with a one-way valve element.

5. The diaphragm means of claim 1, wherein a compression coil spring is disposed between said piston and one end of said cylinder tube.

* * * * *